US008979570B2

(12) United States Patent
Yokoo

(10) Patent No.: US 8,979,570 B2
(45) Date of Patent: Mar. 17, 2015

(54) CONNECTOR CONFIGURED TO TEMPORARILY HOLD AN OBJECT BEING CONNECTED WHILE AN ACTUATOR WHICH IS CLOSED TO LOCK THE OBJECT IS IN AN OPEN STATE

(71) Applicant: Japan Aviation Electronics Ind., Ltd., Shibuya-ku, Tokyo (JP)

(72) Inventor: Hiroyuki Yokoo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 26 days.

(21) Appl. No.: 13/782,722

(22) Filed: Mar. 1, 2013

(65) Prior Publication Data

US 2013/0231002 A1 Sep. 5, 2013

(30) Foreign Application Priority Data

Mar. 1, 2012 (JP) ..... 2012-045805

(51) Int. Cl.
*H01R 13/72* (2006.01)
*H01R 13/64* (2006.01)
(Continued)

(52) U.S. Cl.
CPC ..... *H01R 13/62* (2013.01); *H01R 12/772* (2013.01); *H01R 12/79* (2013.01); *H01R 12/88* (2013.01)
USPC ..... 439/372

(58) Field of Classification Search
CPC ..... H01R 13/62; H01R 12/772; H01R 12/79; H01R 12/88; H01R 12/77; H01R 13/639; H01R 24/00; H01R 12/71
USPC ..... 439/372, 157, 492, 493, 495, 494, 260
See application file for complete search history.

(56) References Cited

U.S. PATENT DOCUMENTS 6,162,083 A 12/2000 Seto
7,077,691 B2 * 7/2006 Yokoo et al. ..... 439/495
(Continued)

FOREIGN PATENT DOCUMENTS

JP 6-17153 U 3/1994
JP 11-74043 A 3/1999
(Continued)

OTHER PUBLICATIONS

Japanese Office Action dated Dec. 19, 2013 (and English translation thereof) in counterpart Japanese Application No. 2012-045805.
(Continued)

*Primary Examiner* — Javaid Nasri
(74) *Attorney, Agent, or Firm* — Holtz, Holtz, Goodman & Chick PC

(57) ABSTRACT

A connector comprises a receiving portion, a housing and an actuator. The housing has a lock portion protruding upward and a recess formed with a bottom portion. The actuator has a pressing portion. The actuator is supported by the housing so as to be pivotable between an open position and a close position. When the actuator is located at the open position, a plate-like or sheet-like object comprising an interposed portion and a locked portion, for example, a Flexible Printed Circuit (FPC), is inserted and received in the receiving portion. When the object is received in the receiving portion, the interposed portion is located above the recess, and the locked portion is located rearward of the lock portion. The pressing portion and the bottom portion interpose the interposed portion of the object when the actuator pivots from the open position to the close position.

7 Claims, 7 Drawing Sheets

(51) Int. Cl.

| | |
|---|---|
| ***H01R 13/62*** | (2006.01) |
| ***H01R 12/77*** | (2011.01) |
| ***H01R 12/79*** | (2011.01) |
| *H01R 12/88* | (2011.01) |

(56) References Cited

U.S. PATENT DOCUMENTS

| | | | |
|---|---|---|---|
| 7,445,494 | B2 | 11/2008 | Wei et al. |
| 7,909,639 | B2 | 3/2011 | Hirata et al. |
| 8,235,739 | B2 | 8/2012 | Hashimoto |

FOREIGN PATENT DOCUMENTS

| | | | |
|---|---|---|---|
| JP | 2007-179760 | A | 7/2007 |
| JP | 2007-194192 | A | 8/2007 |
| JP | 2011-65935 | A | 3/2011 |
| JP | 2011-86428 | A | 4/2011 |
| JP | 2011-181439 | A | 9/2011 |
| JP | 2011-198571 | A | 10/2011 |
| KR | 10-2011-0056450 | A | 5/2011 |

OTHER PUBLICATIONS

Japanese Office Action dated May 16, 2013 (and English translation thereof) in counterpart Japanese Application No. 2012-045805.

Korean Office Action dated Feb. 26, 2014 (and English translation thereof) in counterpart Korean Application No. 10-2013-0019041.

Chinese Office Action dated Nov. 21, 2014, issued in counterpart Chinese Application No. 201310060146.0.

* cited by examiner

CONNECTOR CONFIGURED TO TEMPORARILY HOLD AN OBJECT BEING CONNECTED WHILE AN ACTUATOR WHICH IS CLOSED TO LOCK THE OBJECT IS IN AN OPEN STATE

CROSS REFERENCE TO RELATED APPLICATIONS

An Applicant claims priority under 35 U.S.C. §119 of Japanese Patent Applications No. JP2012-045805 filed Mar. 1, 2012.

BACKGROUND OF THE INVENTION

This invention relates to a connector configured to be connected to a plate-like or sheet-like object such as a Flexible Printed Circuit (FPC) or a Flexible Flat Cable (FFC).

For example, this type of connector is disclosed in JP-A 2011-181439, contents of which are incorporated herein by reference.

The connector disclosed in JP-A 2011-181439 comprises an actuator pivotable between an open position and a close position (see FIG. 13A). The actuator is provided with a lock portion. On the other hand, a plate-like or a sheet-like object is formed with a notch (see FIG. 13B). The object is inserted in the connector when the actuator is located at the open position. When the actuator pivots to the close position, the lock portion protrudes downward to be received in the notch. Accordingly, the object is prevented from being removed from or coming off the connector.

However, as for the connector of JP-A 2011-181439, the object might move out of position before the actuator is operated to pivot. In other words, the connector of JP-A 2011-181439 is unable to temporarily hold the object at a proper position when the actuator is located at the open position. Moreover, when the actuator is located at the close position, a movement of the object is regulated by the lock portion of the actuator. Accordingly, for example, if the connector has such a small size that does not allow the lock portion to have a large width or a large protruding length, the lock portion is unable to lock the object securely. The object therefore might be removed.

SUMMARY OF THE INVENTION

It is therefore an object of the present invention to provide a connector which is more securely preventable the object both from moving out of position before the actuator is operated to pivot and from coming off after the actuator is operated to pivot.

One aspect (first aspect) of the present invention provides a connector into which a plate-like or sheet-like object comprising an interposed portion and a locked portion is insertable rearward along an insertion direction from a front end of the connector. The connector comprises a receiving portion, a housing and an actuator. The receiving portion has a bottom surface. The receiving portion is configured to receive the inserted object. The housing has a lock portion and a recess. The lock portion protrudes upward over the bottom surface of the receiving portion. The recess is located rearward of the lock portion. The recess has a bottom portion. The bottom portion of the recess is located below the bottom surface of the receiving portion. The actuator has a pressing portion. The actuator is supported by the housing so as to be pivotable between an open position and a close position. The actuator located at the open position allows the object to be received in the receiving portion. The interposed portion of the received object is located above the recess. The locked portion of the received object is located rearward of the lock portion. The pressing portion located above the recess and the bottom portion of the recess interposes the interposed portion of the received object when the actuator pivots from the open position to the close position.

An appreciation of the objectives of the present invention and a more complete understanding of its structure may be had by studying the following description of the preferred embodiment and by referring to the accompanying drawings.

Figure 1:
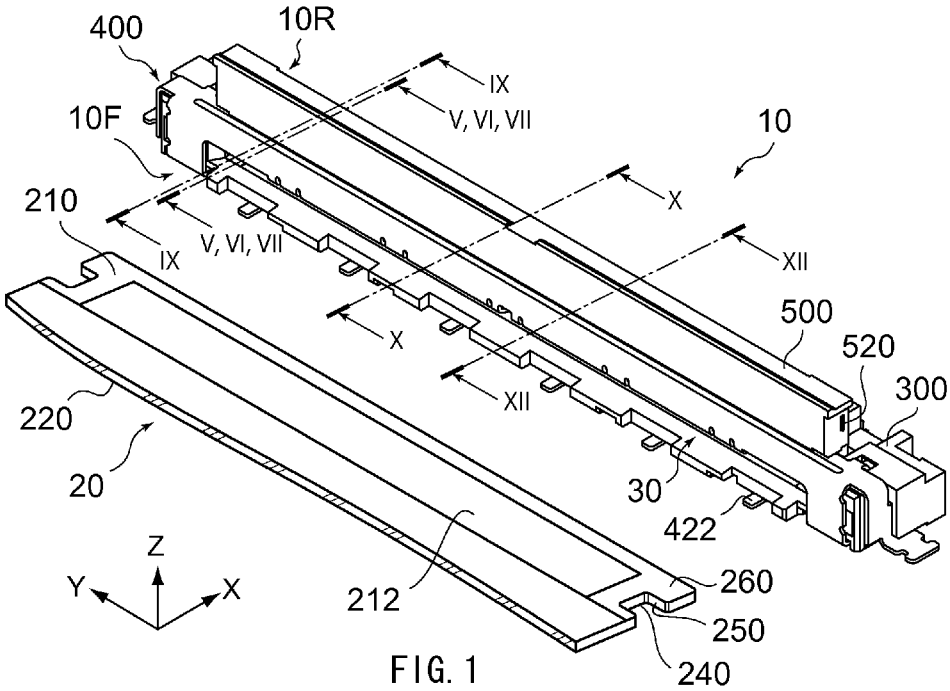
FIG. 1 is a perspective view showing a connector according to an embodiment of the present invention and a front end of an object, wherein an actuator of the connector is located at an open position.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
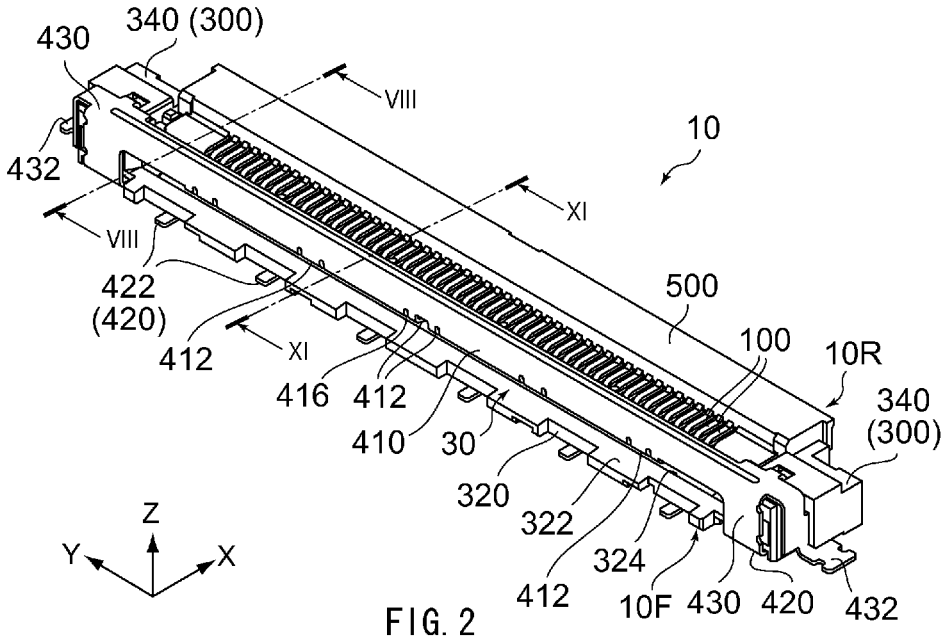
FIG. 2 is a perspective view showing the connector of FIG. 1 under a state where the actuator is located at a close position.
Figure 3:
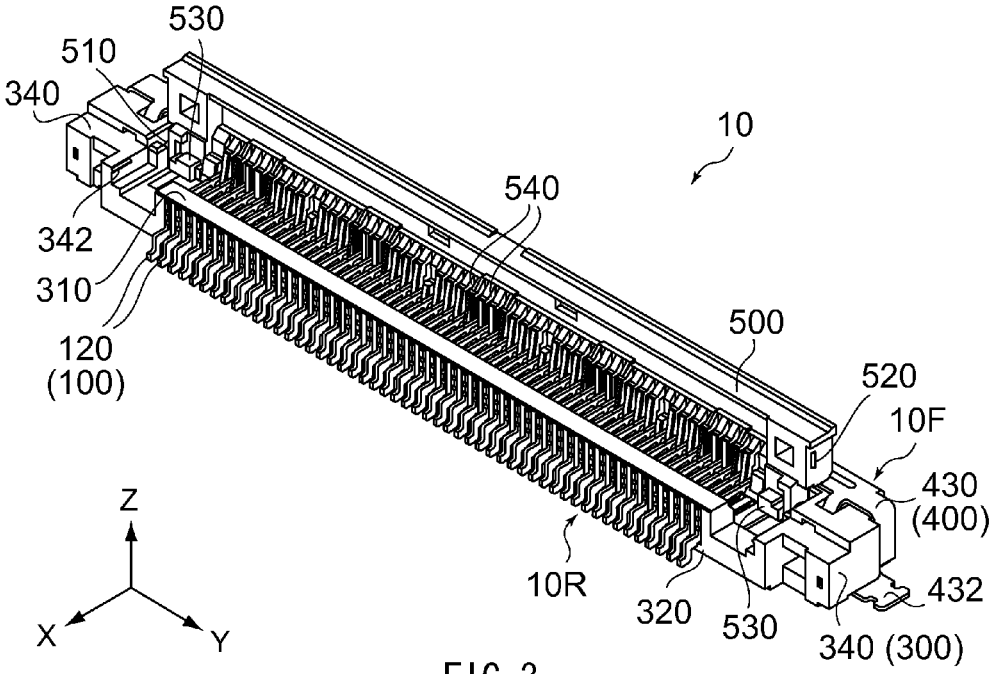
FIG. 3 is a perspective view showing a rear side o the connector of FIG. 1.

As can be seen from FIGS. 1 to 3, a connector 10 according to an embodiment of the present invention is configured to be mounted on a circuit board (not shown). The connector 10 is shaped in a rectangular column-like shape extending along a right-to-left direction (Y-direction). The connector 10 has a front end 10F and a rear end 10R in a front-to-rear direction (X-direction).

The connector 10 is configured so that a plate-like or sheet-like object 20 such as an FPC or an FFC is insertable thereinto from the front end 10F toward the rear end 10R (i.e. rearward) along an insertion direction (X-direction). In detail, the connector 10 is formed with a receiving portion 30 therewithin. The receiving portion 30 opens toward the front end 10F. A width in the Y-direction of the vicinity of the opening of the receiving portion 30 is slightly larger than a width in the Y-direction of the object 20. The object 20 is inserted and received into the receiving portion 30 from the front end 10F to be electrically connected to the connector 10. In other words, the connector 10 comprises the receiving portion 30 which is configured to receive the inserted object 20.

Figure 4:
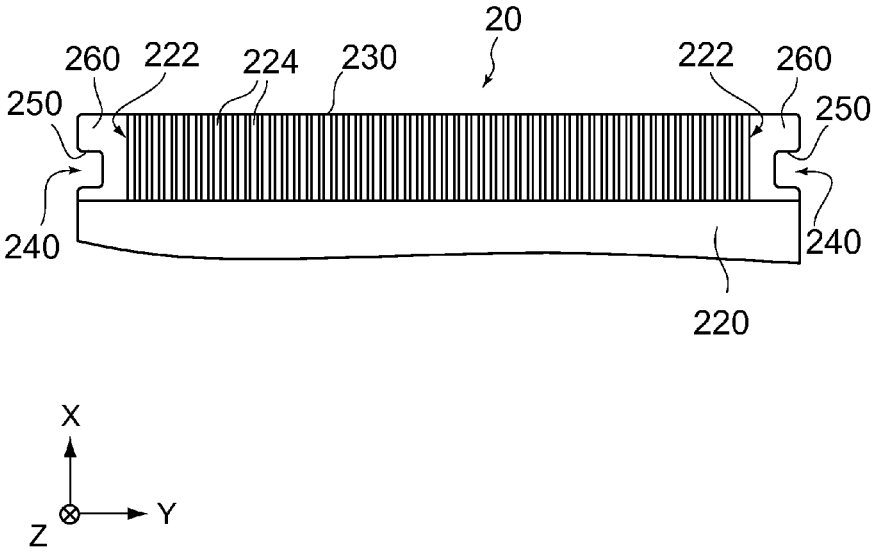
FIG. 4 is a bottom view showing the object of FIG. 1.

As shown in FIGS. 1 and 4, the object 20 according to the present embodiment is formed to have a sheet-like shape extending in parallel to the XY-plane. In detail, the object 20 has two principal surfaces, namely, an upper surface 210 and a lower surface 220 opposing in an upper-to-lower direction (Z-direction), and an insertion end 230 configured to be inserted in the receiving portion 30 of the connector 10. The object 20 has opposite side portions in the Y-direction. Each of the side portions of the object 20 is partially cut so that the object 20 is formed with two notches 240. The notch 240 according to the present embodiment has a rectangular shape so as to be formed with a locked portion 250 having a planar shape perpendicular to the X-direction. The notch 240 is located in the vicinity of the insertion end 230. The object 20 further has two interposed portions 260. Each of the interposed portions 260 is formed between the notch 240 and the insertion end 230. The shape of the notch 240 may not be rectangular, provided that the object 20 comprises the interposed portion 260 and the locked portion 250 configured as described above.

The object 20 has a ground pattern 212 and a belt-like region 222 provided on the upper surface 210 and the lower surface 220, respectively. Each of the ground pattern 212 and the belt-like region 222 extends along the Y-direction. The belt-like region 222 is provided with a plurality of signal patterns (contact points) 224.

As shown in FIGS. 1 to 3, the connector 10 comprises a plurality of contacts 100 each made of a metal, a housing 300 made of an insulating material, a shell 400 made of a metal and an actuator 500 made of an insulating material. The contacts 100 are held by the housing 300 so as to be connectable to the respective contact points 224 of the object 20. The shell 400 according to the present embodiment is attached to the housing 300 from the front end 10F so as to partially cover the housing 300.

The housing 300 is formed so as to extend long in the Y-direction. The housing 300 has two side portions 340 at opposite ends in the Y-direction, respectively. Each of the side portions 340 is formed with a first protrusion 342 protruding inward in the Y-direction (see FIG. 3). The housing 300 has a holding portion 310 and a bottom plate 320 each extending in the Y-direction between the two side portions 340. In detail, the two side portions 340 are coupled by the holding portion 310 at the rear end 10R, and also coupled by the bottom plate 320 at a lower side (i.e. the negative Z-side) of the connector 10.

Figure 5:
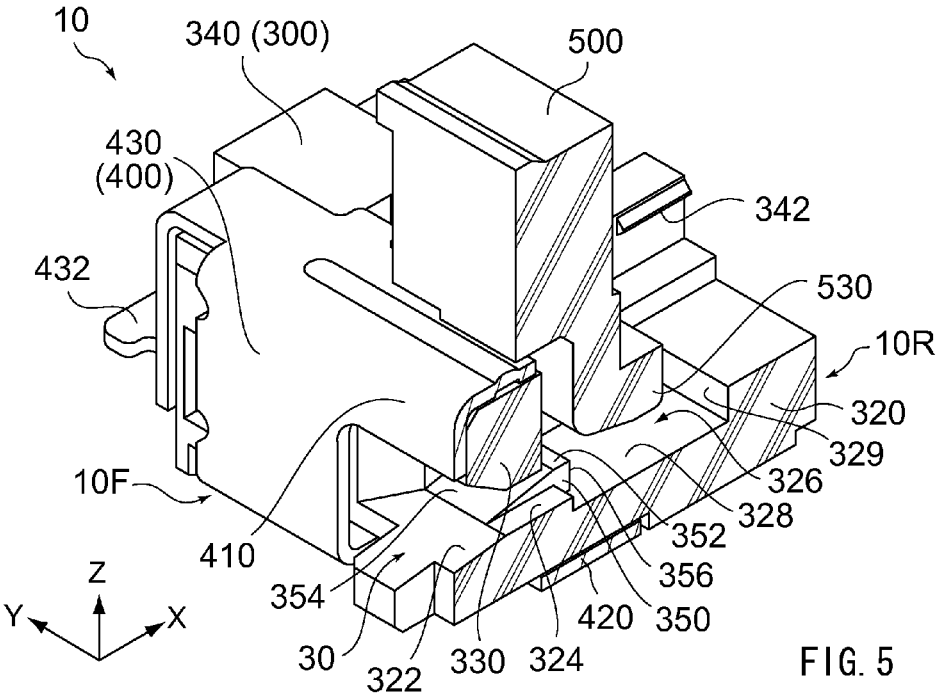
FIG. 5 is a partially cut away, enlarged, perspective view showing a side portion of the connector of FIG. 1, taken along line V-V, wherein lines V-V pass in the vicinity of a lock portion of the connector.

As can be seen from FIG. 5, the housing 300 further has an upper structure 330 which couples the two side portions 340 in the Y-direction. The upper structure 330 extends in the Y-direction above the receiving portion 30. The upper structure 330 has a lower surface in the Z-direction while the receiving portion 30 has an upper surface in the Z-direction. The lower surface of the upper structure 330 is the upper surface of the receiving portion 30 at a side portion of the receiving portion 30 in the Y-direction. ID other words, the upper structure 330 defines an upper part of the receiving portion 30 at the side portion of the receiving portion 30 in the Y-direction.

Figure 6:
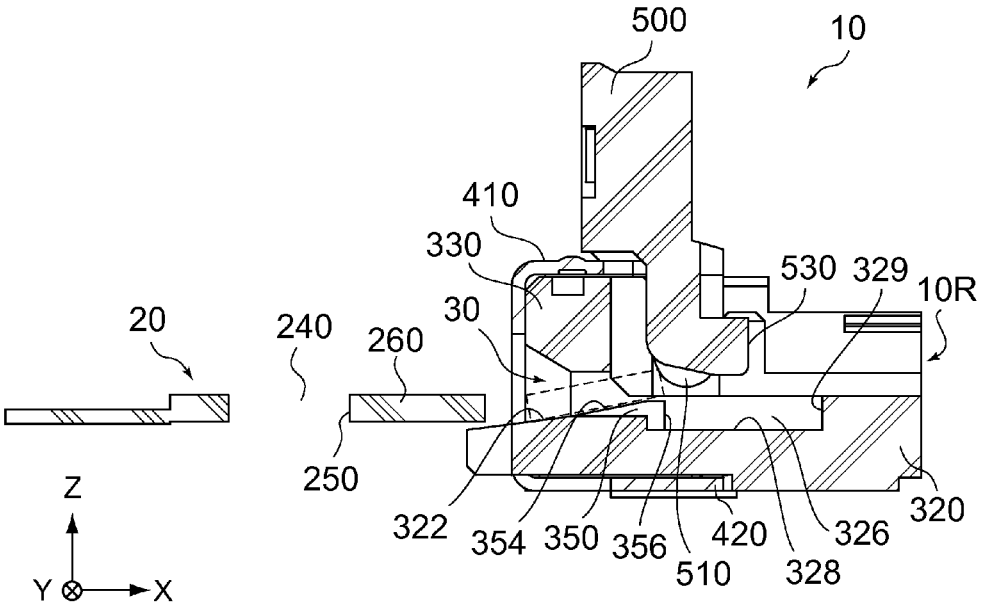
FIG. 6 is a cross-sectional view showing the connector and the object of FIG. 1, taken along line VI-VI, wherein dashed lines schematically illustrate a position of an interposed portion of the object which passes above the lock portion.

As shown in FIGS. 2, 5 and 6, the housing 300 has a guide portion 322, a mount portion 324, two recesses 326 and two lock portions 350 which are formed on an upper surface of the bottom plate 320. According to the present embodiment, two sets each comprised of the one recess 326 and the one lock portion 350 are provided at opposite side portions of the bottom plate 320, respectively. The mount portion 324 extends in the Y-direction so as to couple the two lock portions 350 with each other. In detail, the lock portions 350 is formed at opposite ends of the mount portion 324 so as to be corresponding to the locked portions 250 of the object 20 in the Y-direction, respectively. The guide portion 322 extends on the front side of the mount portion 324 and the lock portions 350 in the Y-direction.

The guide portion 322 is a slope which gently slopes upward from the front end 10F of the connector 10 (i.e. an entrance of the receiving portion 30) to front ends (i.e. the negative X-side ends) of the mount portion 324 and the lock portion 350. In other words, the guide portion 322 extends in the Y-direction while obliquely crossing the X-direction. The mount portion 324 is a horizontal plane extending in parallel to the XY-plane. The mount portion 324 according to the present embodiment is a bottom surface which defines a lower part of the receiving portion 30. In other words, the receiving portion 30 according to the present embodiment has the bottom surface which is formed from the mount portion 324 of the housing 300 (i.e. a part of the housing 300).

As shown in FIGS. 5 and 6, the recess 326 is located rearward of the lock portion 350. In other words, the recess 326 is located between the lock portion 350 and the rear end 10R in the X-direction. The recess 326 according to the present embodiment is a recess formed in the upper surface of the bottom plate 320. The recess 326 has a bottom portion 328 and a rear wall 329. The bottom portion 328 according to the present embodiment is a plane extending in parallel to the XY-plane. The bottom portion 328 is located below the mount portion 324 (i.e. the bottom surface of the receiving portion 30) in the Z-direction. The rear wall 329 according to the present embodiment is a plane perpendicular to the X-direction.

Figure 9:
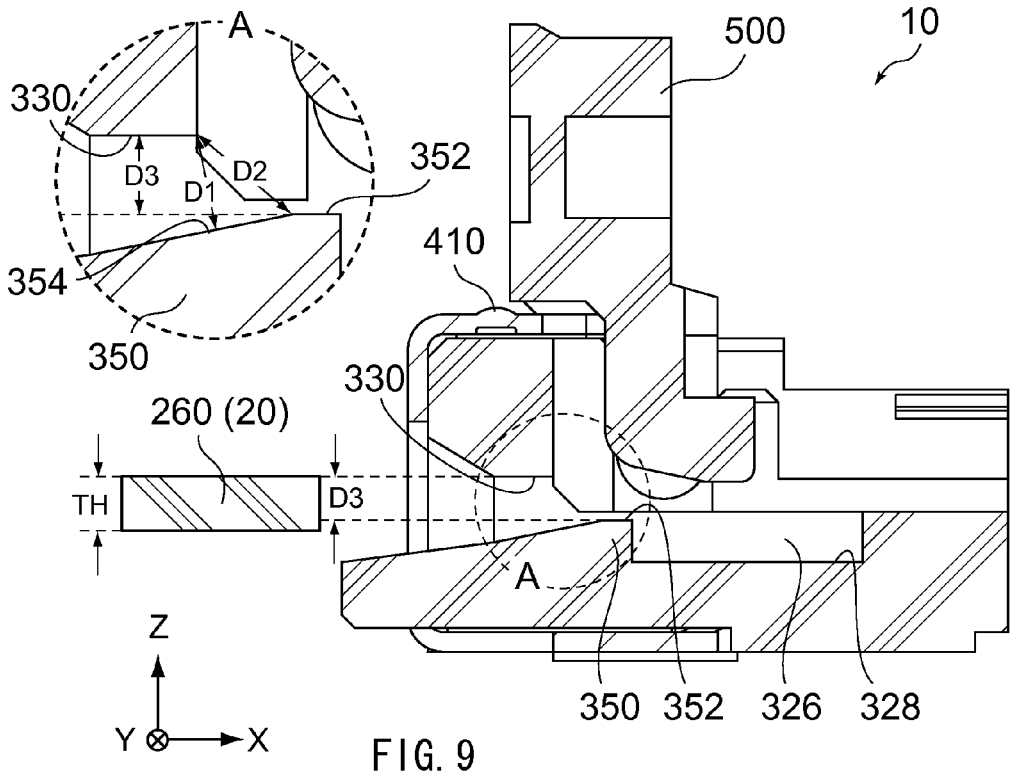
FIG. 9 is a cross-sectional view showing the connector and the object of FIG. 1, taken along line IX-IX, wherein lines IX-IX pass the lock portion.

As shown in FIGS. 5, 6 and 9, the lock portion 350 protrudes upward (i.e. in the positive Z-direction) from the recess 326 over the mount portion 324. In other words, the lock portion 350 protrudes upward over the bottom surface of the receiving portion 30. The lock portion 350 has a top portion 352, a slope portion 354 and a lock surface 356. The top portion 352 according to the present embodiment is a plane extending in parallel to the XY-plane. The slope portion 354 slopes obliquely downward and forward (i.e. in the negative X-direction) from the top portion 352 to reach to the guide portion 322. The lock surface 356 according to the present embodiment is formed to have a planar shape perpendicular to the X-direction. The lock surface 356 is located rearward of the top portion 352.

As can be seen from FIGS. 1 to 3 and 5, the shell 400 according to the present embodiment is formed by stamping and bending a single metal sheet. The shell 400 has an upper portion 410, a lower portion 420 and two side portions 430. The upper portion 410 extends in the Y-direction so as to cover the upper structure 330 of the housing 300 (see FIG. 5). The lower portion 420 extends in the Y-direction along a lower surface of the bottom plate 320 of the housing 300 (see FIG. 5). The two side portions 430 are located at opposite ends of the shell 400 in the Y-direction, respectively. Each of the side portions 430 connects the upper portion 410 and the lower portion 420 to each other in the Z-direction.

Figure 10:
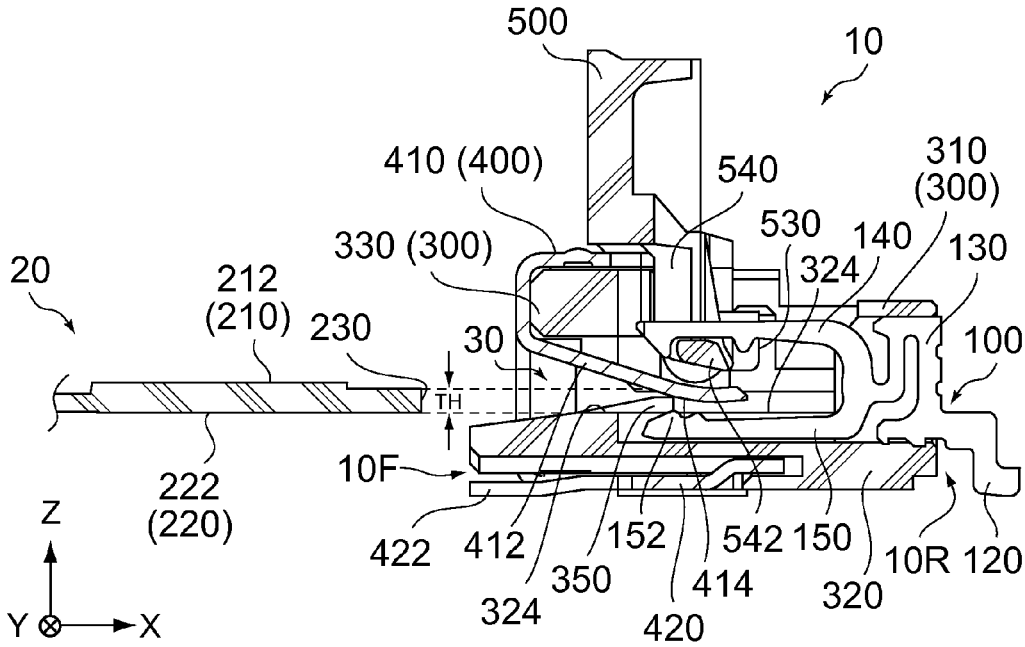
FIG. 10 is a cross-sectional view showing the connector and the object of FIG. 1, taken along line X-X, wherein lines X-X pass an accommodating portion of the actuator and a pushing portion of a shell.
Figure 12:
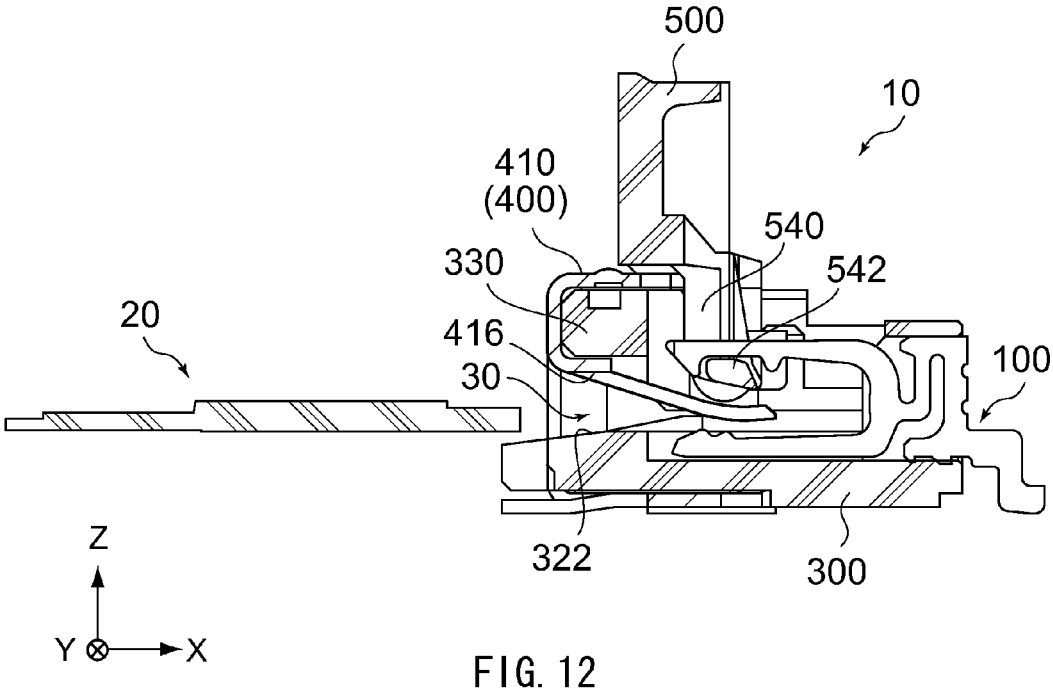
FIG. 12 is a cross-sectional view showing the connector and the object of FIG. 1, taken along line XII-XII, wherein lines XII-XII pass the accommodating portion of the actuator and a grasp portion of the shell.
Figure 13A:
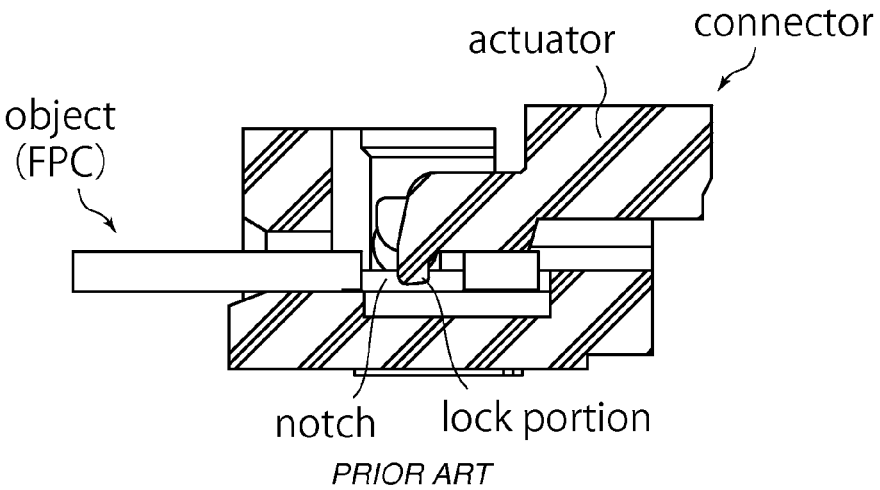
FIG. 13A is a cross-sectional view showing an existing connector and an object held by the existing connector, wherein an actuator of the connector is located at a close position.
Figure 13B:
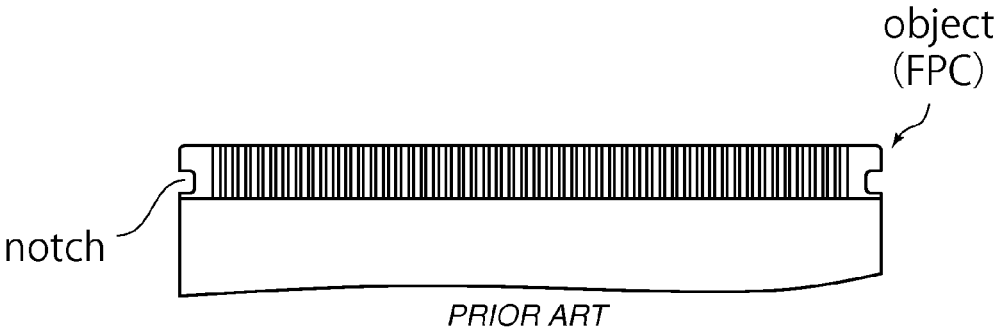
FIG. 13B is a top view showing the object of FIG. 13A.

As can be seen from FIGS. 2, 10 and 12, a middle part in the Y-direction of the upper portion 410 is, for the most part, bent toward the inside of the housing 300 so as to cover a lower side of the upper structure 330. In detail, the middle part of the upper portion 410 has a plurality of pushing portions 412 (see FIG. 10) and a plurality of grasp portions 416 (see FIG. 12) which are formed intermittently.

The pushing portion 412 extends in the positive X-direction so as to be resiliently deformable in the Z-direction. More specifically, the pushing portion 412 extends beyond the lock portion 350 in the X-direction while sloping downward. The grasp portion 416 is located above the guide portion 322. More specifically, the grasp portion 416 covers the lower side of the upper structure 330 so as to grasp the upper structure 330 in the Z-direction. According to the present embodiment, the grasp portion 416 configured as described above prevents the upper portion 410 from moving in the Z-direction. As can be seen from the above description, the pushing portions 412 and the grasp portions 416 define the upper part of the receiving portion 30 at a middle part of the receiving portion 30 in the Y-direction. The pushing portion 412 has an end which is slightly curved downward so that the pushing portion 412 is formed with a contact part 414.

As can be seen from FIGS. 1 to 3 and 10, the lower portion 420 of the shell 400 is provided with a plurality of connecting portions 422 configured to be electrically connected to a ground pattern of the circuit board (not shown). Each of the side portions 430 is provided with a hold-down 432 configured to be fixed to the circuit board (not shown). The hold-down 432 extends downward (i.e. in the negative Z-direction) from an upper part of the side portion 430.

As shown in FIGS. 1 to 3, the actuator 500 has a plate-like shape which is long in the Y-direction. The actuator 500 has two pivot shafts 510 formed at opposite ends thereof in the Y-direction, respectively. The pivot shafts 510 are supported by the housing 300 so as to be pivotable. In detail, the actuator 500 is supported by the housing 300 so as to be pivotable between an open position (the position shown in FIGS. 1 and 3) where the object 20 is insertable into the receiving portion 30 of the connector 10 and a close position (the position shown in FIG. 2) where the object 20 is held by and connected to the connector 10.

As shown in FIGS. 3 and 5, the actuator 500 is formed with two second protrusions 520 at opposite ends thereof in the Y-direction, respectively. The second protrusions 520 protrude outward in the Y-direction. When the actuator 500 pivots to the close position, each of the second protrusion 520 surmounts the first protrusion 342 to be located under the first protrusion 342. The first protrusion 342 locks the second protrusion 520 so that the actuator 500 located at the close position is prevented from pivoting to the open position. According to the present embodiment, the actuator 500 located at the close position is prevented from unintentionally returning to the open position.

Figure 8:
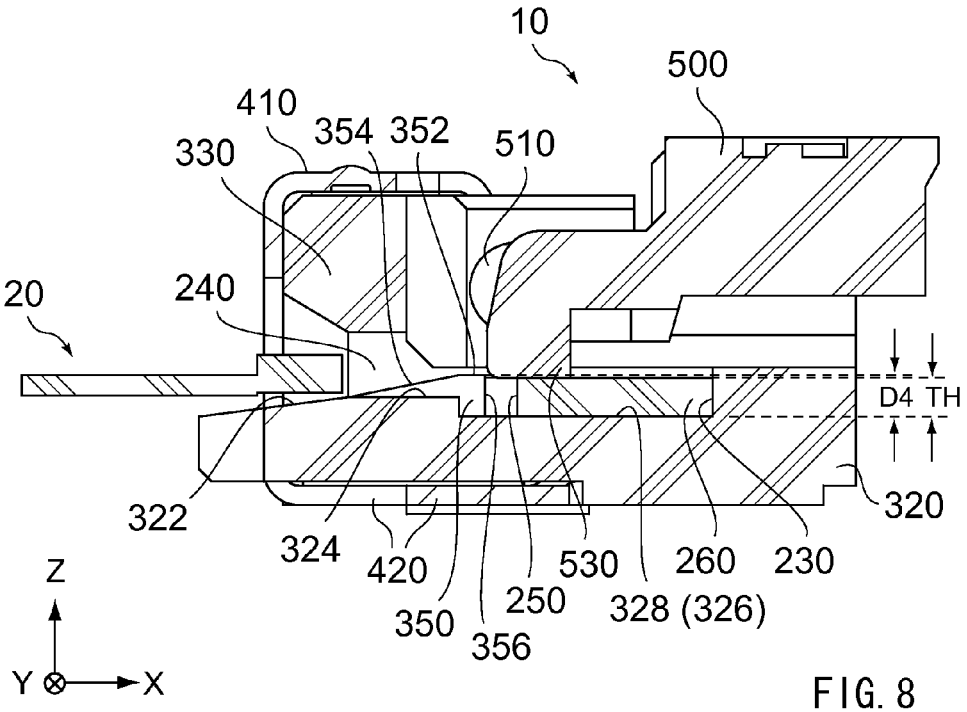
FIG. 8 is a cross-sectional view showing the connector and the object of FIG. 2 in a state where the object is received and held, taken along line VIII-VIII, wherein lines VIII-VIII pass in the vicinity of the lock portion.

As can be seen from FIGS. 3, 5, 6 and 8, the actuator 500 is formed with two pressing portions 530 at the opposite ends thereof in the Y-direction, respectively. As shown in FIGS. 5 and 6, the pressing portion 530 extends toward the rear end 10R of the connector 10 (i.e. in the positive X-direction) when the actuator 500 is located at the open position. As shown in FIG. 8, when the actuator 500 is located at the close position, the pressing portion 530 is located above the recess 326 and extends downward (i.e. in the negative Z-direction).

As can be seen from FIGS. 3 and 10, the actuator 500 is formed with a plurality of accommodating portions 540 each corresponding to the contact 100. The accommodating portion 540 according to the present embodiment is a slit piercing the actuator 500 located at the open position in the X-direction (see FIG. 10). Each of the accommodating portions 540 is formed with a push-up portion 542 therewithin. The push-up portion 542 extends long in the X-direction when the actuator 500 is located at the open position.

As shown in FIGS. 3 and 10, the contacts 100 are press-fit in the housing 300 forward from the rear end 10R of the connector 10. Each of the contacts 100 has a terminal portion 120 and a held portion 130. The terminal portion 120 is configured to be electrically connected to a signal pattern of the circuit board (not shown). The held portion 130 is caught by the holding portion 310 and the bottom plate 320 of the housing 300 in the Z-direction so that the contact 100 is fixed to the housing 300. A part of the contact 100 has a U-like shape which is comprised of an upper arm 140 and a lower arm 150. The upper arm 140 and the lower arm 150 extend in the negative X-direction (i.e. toward the front end 10F) from the held portion 130 while facing in the Z-direction each other.

As shown in FIG. 10, the upper arm 140 of the contact 100 passes through the accommodating portion 540 so as to be located on the push-up portion 542 of the actuator 500. The lower arm 150 extends along the upper surface of the bottom plate 320 to be accommodated in a ditch formed in the bottom plate 320. The lower arm 150 is provided with a contact portion 152 at an end thereof. The contact portion 152 protrudes upward (i.e. in the positive Z-direction).

Figure 7:
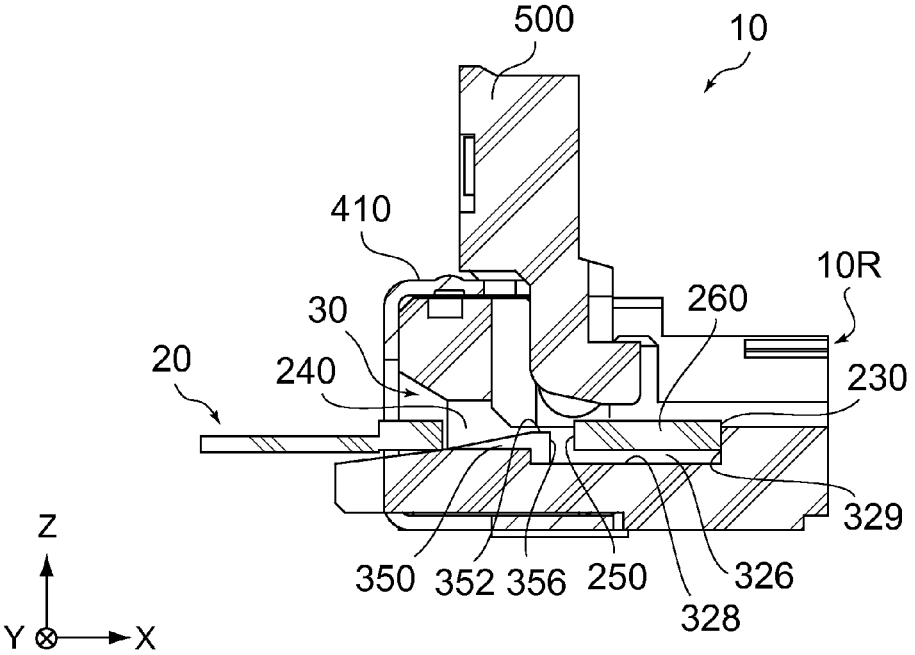
FIG. 7 is a cross-sectional view showing the connector and the object of FIG. 1 in a state where the object is received and temporarily held, taken along line VII-VII.

As can be seen from FIGS. 5 to 7, when the actuator 500 of the connector 10 configured as described above is located at the open position, the object 20 is able to be inserted and received into the receiving portion 30 along the positive X-direction. In other words, as described below, the actuator 500 located at the open position allows the object 20 to be received in the receiving portion 30. At first, the interposed portion 260 of the object 20 inserted in the receiving portion 30 is guided by the guide portion 322 and the slope portion 354 of the lock portion 350 to move toward the rear end 10R while inclining upward.

As shown in FIG. 9, according to the present embodiment, each of a minimum distance D1 between the upper structure 330 and the slope portion 354 of the lock portion 350 and a minimum distance D2 between the upper structure 330 and the top portion 352 of the lock portion 350 is larger than a thickness TH of the object 20. Moreover, the object 20 according to the present embodiment has such a flexibility that allows the object 20 to be partially resiliently deformed without being damaged. Accordingly, the interposed portion 260 is able to surmount the top portion 352 while bending upward even if a distance D3 in the Z direction between the upper structure 330 and the top portion 352 of the lock portion 350 is smaller than the thickness TH of the interposed portion 260 of the object 20 (see FIG. 6).

As shown in FIG. 7, when the interposed portion 260 surmounts the top portion 352, the object 20 is received in the receiving portion 30. The interposed portion 260 of the received object 20, which is received in the receiving portion 30, is located above the recess 326, and the locked portion 250 of the received object 20 being located rearward of the lock portion 350. The lock portion 350 is thus received in the notch 240 so that the interposed portion 260 moves downward. When the lock portion 350 is located in the notch 240, the object 20 is in a temporarily-held state. When the object 20 in the temporarily-held state is further moved in the positive X-direction, the insertion end 230 is brought into abutment with the rear wall 329 of the recess 326 so that the object 20 is (fully) received in the connector 10. As can be seen from the above description, the insertion end 230 is unable to move rearward beyond the rear wall 329. In other words, the rear wall 329 defines a moving range of the object 20 in the positive X-direction.

When the object 20 is in the temporarily-held state, the locked portion 250 of the object 20 and the lock surface 356 of the lock portion 350 are partially brought into abutment with each other even if the object 20 receives a forward force (i.e. a force toward the negative X-direction). This abutment temporarily prevents the object 20 from moving forward to be out of position or removed. In other words, the connector 10 comprises the lock surface 356 which locks the locked portion 250 of the object 20 in the temporarily-held state so as to prevent the object 20 from moving out of position. Accordingly, it is unnecessary to support the object 20 by some members when the actuator 500 pivots from the open position to the close position.

Figure 11:
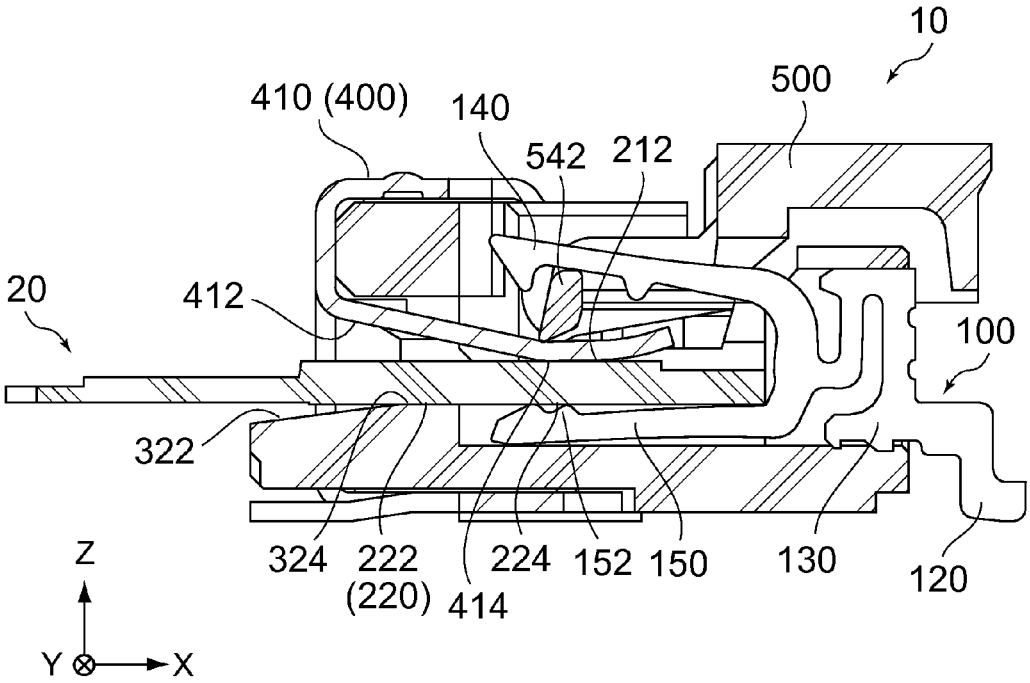
FIG. 11 is a cross-sectional view showing the connector and the object of FIG. 2 in the state where the object is received and held, taken along line XI-XI, wherein lines XI-XI pass the accommodating portion of the actuator and the pushing portion of the shell.

As can be seen from FIGS. 10 and 11, under a state where the object 20 is not inserted, a distance in the Z-direction between the pushing portion 412 and the mount portion 324 is designed to be smaller than the thickness TH of the insertion end 230 of the object 20. The object 20, which is inserted into the receiving portion 30, moves in the positive X-direction while receiving a downward force from the pushing portion 412. Accordingly, when the locked portion 250 surmounts the top portion 352 and the object 20 is transferred to the temporarily-held state (see FIG. 7), a click feeling is generated. It is possible to know by this click feeling that the object 20 is in the temporarily-held state. According to the present embodiment, the thickness TH of a middle part of the insertion end 230 in the Y-direction is same as the thickness TH of the interposed portion 260. However, these two thicknesses may be different from each other. For example, the thickness of the interposed portion 260 may be larger.

As can be seen from FIGS. 7, 10 and 11, when the object 20 is in the temporarily-held state, a middle part of the object 20 in the Y-direction is pushed downward by the pushing portion 412 of the shell 400. Accordingly, the belt-like region 222 provided on the lower surface 220 of the object 20 is pressed against the mount portion 324. In other words, the pushing portion 412 according to the present embodiment pushes the belt-like region 222 of the object 20, which is received in the receiving portion 30, toward the mount portion 324 when the actuator 500 is located at the open position so that the object 20 is temporarily prevented from moving upward. According to the present embodiment, the upper surface 210 of the object 20 is pushed by the pushing portion 412 so that the temporarily-held state of the object 20 is maintained.

As shown in FIGS. 7 and 8, the actuator 500 is able to be turned from the open position to the close position when the object 20 is received in the receiving portion 30 to be in the temporarily-held state. The pressing portion 530 of the actuator 500 and the bottom portion 328 of the recess 326 interpose the interposed portion 260 of the received object 20 when the actuator 500 pivots from the open position to the close position. According to the present embodiment, the interposed portion 260 is pressed against the bottom portion 328 by the pressing portion 530 so that the object 20 is transferred to a (completely) held state.

As can be seen from FIG. 8, when the object 20 is in the held-state, the interposed portion 260 is sandwiched by the pressing portion 530 and the bottom portion 328. Accordingly, a forward movement of the object 20 is prevented if a forward force (i.e. a force along the negative X-direction) is applied to the object 20. Even if the object 20 moves forward, the locked portion 250 of the object 20 and the lock surface 356 of the lock portion 350 are brought into contact with each other so that the object 20 is prevented from further moving forward to come off the connector 10.

As can be seen from FIGS. 8 and 9, according to the present embodiment, it is possible to shorten the distance D3 in the Z-direction between the upper structure 330 and the top portion 352 of the lock portion 350 without enlarging a height (i.e. a size in the Z-direction) of the connector 10 (see FIG. 9). In other words, even when a distance in the Z-direction between the mount portion 324 and the top portion 352 (i.e. a height of the lock surface 356 relative to the mount portion 324) is small, it is possible to enlarge a height D4 of the lock surface 356 without enlarging the height of the connector 10. Moreover, it is possible to enlarge a distance in the Z-direction between the bottom portion 328 and the top portion 352 (i.e. the height D4 of the lock surface 356) by depressing the recess 326 deeply while keeping the height of the lock surface 356 relative to the mount portion 324 at a predetermined size. As can be seen from the above description, according to the present embodiment, it becomes possible to more securely temporarily-hold or hold the object 20 without enlarging the height (i.e. the size in the Z-direction) of the connector 10.

Moreover, it is possible to more securely hold the object 20 if the height D4 of the lock surface 356 is larger than the thickness TH of the object 20. However, the height D4 of the lock surface 356 may be smaller than the thickness TH of the object 20 if the recess 326 is unable to be depressed deeply, for example, when the connector 10 is required to have as small height as possible.

As can be seen from FIGS. 7 and 8, an angle value of the slope portion 354 according to the present embodiment is larger than an angle value of the guide portion 322. Accordingly, it is possible to make the height D4 of the lock surface 356 higher.

The lock surface 356 according to the present embodiment is a vertical plane. Nevertheless, if the object 20 has a sufficient flexibility, it is possible to remove the object 20 in the temporarily-held state even when the height D4 of the lock surface 356 is large. However, an upper part of the lock surface 356 may be formed as a slope if it is important to more easily remove the object 20.

As shown in FIGS. 10 and 11, the push-up portion 542 of the actuator 500 rotates to extend long in the Z-direction when the actuator 500 pivots to the close position under the state where the object 20 is received in the receiving portion 30. Accordingly, the push-up portion 542 pushes the upper arm 140 upward and presses the pushing portion 412 downward toward the object 20. The object 20 is pressed downward by a pressing force applied from the push-up portion 542 so that the belt-like region 222 of the object 20 is placed on and pressed against the mount portion 324.

As can be seen from the above description, the object 20 is securely held between the resiliently deformed pushing portion 412 and the mount portion 324. Furthermore, according to the present embodiment, the object 20 is caught by the pushing portion 412 and the lower arm 150 so that the held state of the object 20 is more securely maintained. Moreover, according to the present embodiment, it is possible to prevent the middle part of the object 20 in the Y-direction from bending upward even when the interposed portions 260 (i.e. the side portions in the Y-direction) of the object 20 move downward (see FIG. 8). It is preferred to provide a plurality of the regularly spaced pushing portions 412 in order to obtain the aforementioned effect. Otherwise, the pushing portion 412 may be provided at a central part of the connector 10 in the Y-direction.

As shown in FIG. 11, when the object 20 is in the held state, the contact portion 152 of the lower arm 150 is moved upward by the movement of the actuator 500 toward the close position. Meanwhile, the object 20 is pressed toward the mount portion 324 so that the contact point 224 of the object 20 moves downward. The upward moved contact portion 152 is pressed against the downward moved contact point 224 so that the contact point 224 is electrically connected to the contact portion 152 of the lower arm 150. Simultaneously, the contact part 414 of the pushing portion 412 is electrically connected to the ground pattern 212 of the object 20. Accordingly, the contact point 224 and the ground pattern 212 are electrically connected to the signal pattern and the ground pattern of the circuit board (not shown), respectively.

The present embodiment may be modified variously. For example, the bottom surface of the receiving portion 30 (i.e. the mount portion 324) may be not a part of the housing 300 but a part of the shell 400. For example, the lower portion 420 of the shell 400 may be bent rearward after extending forward so that the mount portion 324 may be formed. Moreover, the pushing portion 412 may be formed separately from the shell 400. Moreover, the lock portion 350 may be provided at a proper position corresponding to the shape of the object 20. For example, the only one lock portion 350 may be formed at the central part of the connector 10 in the Y-direction.

The present application is based on a Japanese patent application of JP2012-045805 filed before the Japan Patent Office on Mar. 1, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector into which a plate-like or sheet-like object comprising an interposed portion and a locked portion is insertable rearward along an insertion direction from a front end of the connector, the connector comprising:

a receiving portion having a bottom surface, the receiving portion being configured to receive the inserted object;

a housing having a lock portion and a recess, the lock portion protruding upward over the bottom surface of the receiving portion, the recess being located rearward of the lock portion, the recess having a bottom portion, the bottom portion of the recess being located below the bottom surface of the receiving portion; and an actuator having a pressing portion, the actuator being supported by the housing so as to be pivotable between an open position and a close position, wherein in a state in which the actuator is located at the open position, the object is receivable in the receiving portion, and in a state in which the object is received in the receiving portion, the interposed portion of the received object is located above the recess, and the locked portion of the received object is located rearward of the lock portion, the lock portion preventing the object from being moved forward so that the pressing portion located above the recess and the bottom portion of the recess interpose the interposed portion of the received object when the actuator pivots rearward of the lock portion from the open position to the close position.

2. The connector as recited in claim 1, wherein the lock portion has a top portion, a slope portion and a lock surface, the slope portion sloping obliquely downward and forward from the top portion, the lock surface being located rearward of the top portion so as to be lockable with the locked portion.

3. The connector as recited in claim 2, further comprising an upper structure, wherein:

the upper structure defines an upper part of the receiving portion;

a distance between the upper structure and the top portion of the lock portion in an upper-to-lower direction perpendicular to the insertion direction is smaller than a thickness of the object; and each of a minimum distance between the upper structure and the slope portion of the lock portion and a minimum distance between the upper structure and the top portion of the lock portion is larger than the thickness of the object.

4. The connector as recited in claim 3, wherein a distance between the bottom portion of the recess and the top portion in the upper-to-lower direction is larger than the thickness of the object.

5. The connector as recited in claim 1, wherein the bottom surface of the receiving portion is formed from a part of the housing.

6. The connector as recited in claim 5, further comprising a contact, wherein:

the object has a belt-like region provided with a contact point;

the contact is held by the housing so as to be connectable to the contact point of the object;

the housing has a mount portion, the belt-like region of the object being placed on the mount portion when the actuator pivots to the close position in a state in which the object is received in the receiving portion; and the bottom surface of the receiving portion is formed from the mount portion of the housing.

7. The connector as recited in claim 6, further comprising a pushing portion, wherein the pushing portion pushes the belt-like region of the object, which is received in the receiving portion, toward the mount portion so that the object is temporarily prevented from moving upward.

* * * * *